United States Patent [19]

Johnson

[11] 4,201,428

[45] May 6, 1980

[54] CABINET ASSEMBLY

[75] Inventor: Frank S. Johnson, Chicago, Ill.

[73] Assignee: Marvel Metal Products Company, Chicago, Ill.

[21] Appl. No.: 968,758

[22] Filed: Dec. 13, 1978

[51] Int. Cl.[2] ..... A47B 43/00

[52] U.S. Cl. ..... 312/257 R; 312/108; 312/111; 312/263

[58] Field of Search ..... 312/257 R, 257 SK, 257 SM, 312/257 A, 263, 107, 111, 108, 140, 198, 289; 108/61; 211/184

[56] References Cited

U.S. PATENT DOCUMENTS

| | | | |
|---|---|---|---|
| 795,957 | 8/1905 | Cartland | 312/257 R |
| 1,944,394 | 1/1934 | Bales et al. | 312/263 |
| 2,072,383 | 3/1937 | Rottman | 312/263 |
| 2,505,299 | 4/1950 | Muller | 312/257 R |
| 3,065,038 | 11/1962 | Pipe | 312/263 |
| 3,338,647 | 8/1967 | Schreyer | 312/198 |
| 3,480,345 | 11/1969 | Torok | 312/257 R |
| 3,731,956 | 5/1973 | Hanley | 312/111 |
| 3,857,619 | 12/1974 | Adickes | 312/198 |
| 4,055,373 | 10/1977 | Andresen et al. | 312/108 |
| 4,077,686 | 3/1978 | Bukaitz | 312/257 R |

FOREIGN PATENT DOCUMENTS

| | | | |
|---|---|---|---|
| 402315 | 5/1966 | Switzerland | 312/257 R |
| 960363 | 6/1964 | United Kingdom | 312/257 SM |

*Primary Examiner*—Victor N. Sakran

*Attorney, Agent, or Firm*—Wallenstein, Spangenberg, Hattis & Strampel

[57] ABSTRACT

A knockdown cabinet assembly, including as an optional feature a side table or shelf assembly. The assembly has side panels, a rear or back panel, and bottom and top crosspieces which are interengaged without the need for conventional fastening means such as screws, bolts, nuts, or the like. The top of the cabinet assembly is provided with screws, the heads of which easily slide into engagement with openings formed in an upper flange on the side panels. Doors are provided for the cabinet assembly, and shelf supporting means are secured on the inner wall of the side or back panels for receiving one or more shelves. The side table or shelf assembly is provided with legs and is adapted to be secured to one of the side panels of the cabinet assembly. Shelf-supporting means is provided on the legs of the side table assembly which cooperate with means on one end of the shelf for securing the shelf to a side panel of the cabinet.

11 Claims, 27 Drawing Figures

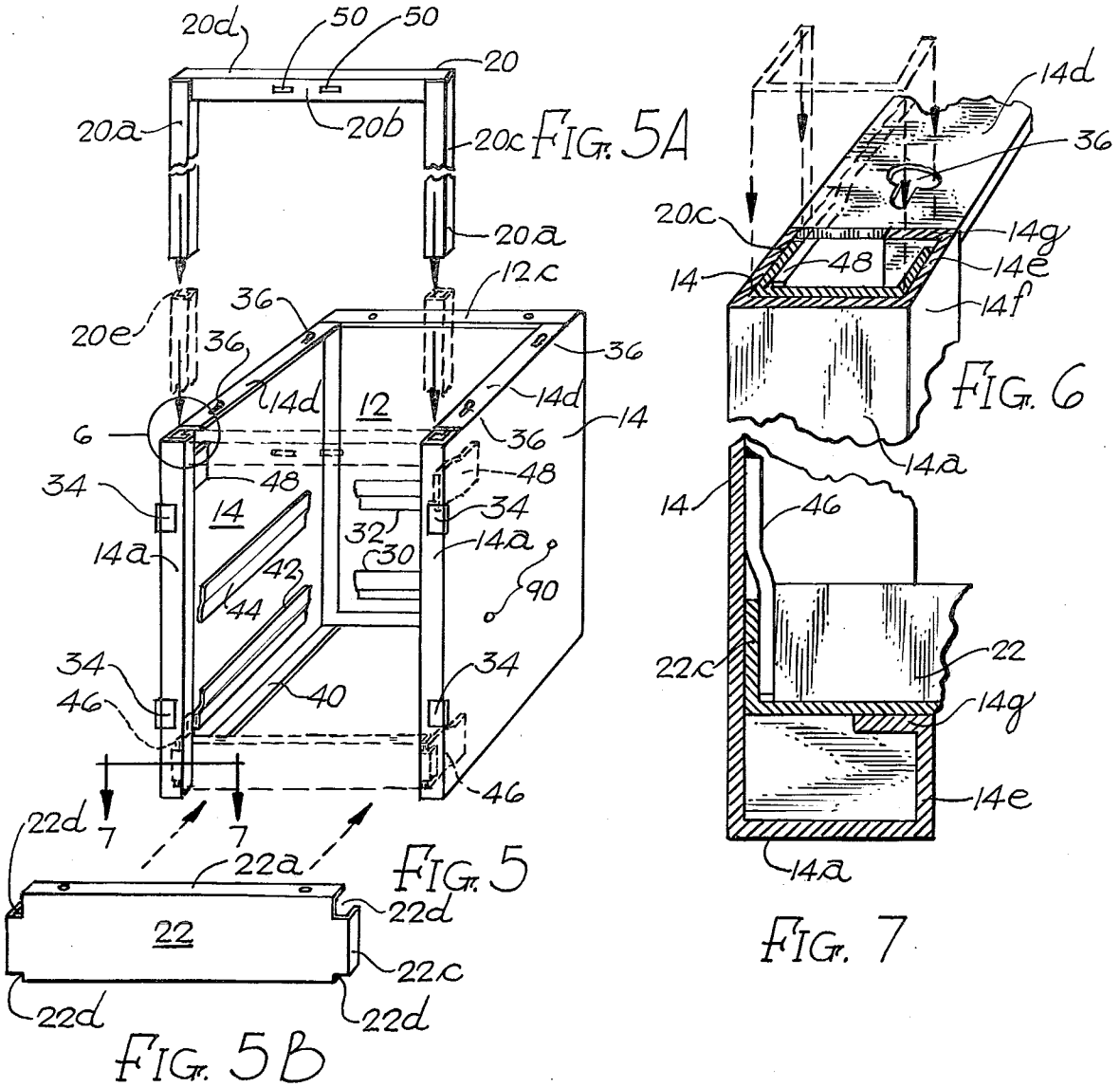
FIG. 5
FIG. 5A
FIG. 5B
FIG. 6
FIG. 7
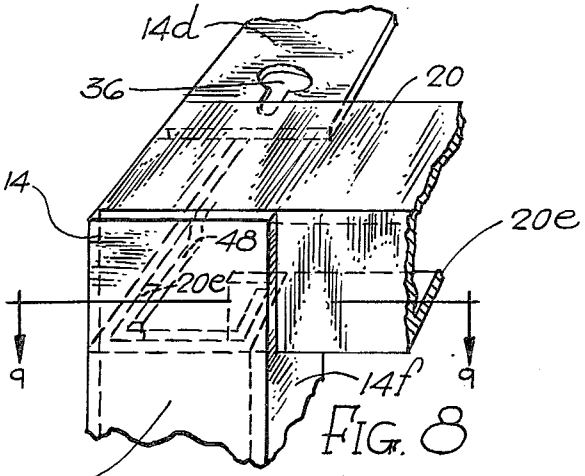
FIG. 8
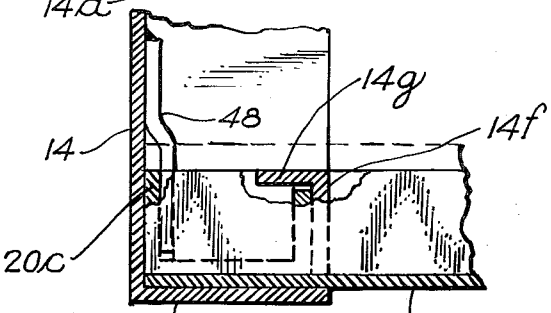
FIG. 9

CABINET ASSEMBLY

The present invention relates to a cabinet assembly, and, in particular, is directed to an improved cabinet assembly of the knockdown type having, as an optional feature, a side table or shelf extension.

The advantages of knockdown type cabinets both to the manufacturer and to the ultimate user of such cabinets are well known. From the standpoint of the manufacturer, knockdown cabinets have significant economic advantages in that they do not require assembly at the plant site, resulting in important savings in machinery and labor costs. In addition, since assembly is not carried out at the plant site, the cabinets can be packaged in smaller, easier to handle, compact containers, resulting not only in a reduction in material and handling costs, but, also, in shipping costs. From the standpoint of the ultimate user, the lower manufacturing costs of such cabinets are passed on to the purchaser. This savings is somewhat dulled by the fact that the user is required to assemble the cabinet before use. However, the construction of knockdown cabinets is characterized in that assembly generally can be accomplished with only a few simple tools, and in a short time with minimal effort on the part of the assembler.

In accordance with the present invention, an improved knockdown cabinet assembly has been evolved which has structural features which, apart from enabling it to be packaged in an easily handled, compact container, enables it to be assembled by the ultimate user by simply sliding the various components of the cabinet into rigid, interlocking engagement with one another. Only the top of the cabinet assembly requires the use of a tool such as a screw driver to tighten four preinstalled screws. As an optimal feature, the cabinet assembly can be provided with a side table or shelf assembly which, like the cabinet assembly, is packaged and shipped disassembled, and which can be readily and easily attached to the cabinet assembly. Shelves advantageously are provided for both the cabinet and the side table or shelf assemblies.

The cabinet assembly, in brief, comprises a back panel which is slidably engageable with a pair of side panels. A bottom rail and a top rail are provided which also are slidably engageable with the side panels. A bottom panel is slidably engageable with the back and side panels, and is supported in part by the bottom rail. The top of the cabinet assembly is provided with preinstalled screws which are received in openings formed in flanges on the side panels. Hinge means are provided on the side panels to enable doors to be installed on the cabinet. The back panel and the side panels desirably are provided with shelf support means for receiving one or more shelves. The optional side table or shelf assembly has a top panel provided with an extension which is engageable on one of the side panels of the cabinet assembly. Easily installed legs and a shelf comprise additional components of the side table or shelf assembly. The assembled structure is extremely rigid and stable, and is capable of supporting objects of substantial weight. In addition, it provides a large working surface area as well as appreciable storage space, while serving as an attractive office or home furnishing.

The foregoing, and other advantages and features of the cabinet assembly will become apparent from the following description taken in conjunction with the accompanying drawings in which.

FIGS. 5, 5A and 5B comprise exploded views showing the positions of the bottom and top rails in relation to the side panels of the cabinet assembly, with a portion of the top rail being broken away;

FIG. 6 is an enlarged fragmentary view in perspective taken at 6 in FIG. 5;

FIG. 7 is an enlarged fragmentary view taken substantially along line 7—7 of FIG. 5;

FIG. 8 is an enlarged fragmentary view in perspective corresponding to the view shown in FIG. 6 with the top engaged on one of the side panels;

FIG. 9 is a fragmentary sectional view taken substantially along line 9—9 of FIG. 8.

Figures 10, 11, 12, 13, 14, 15, 16, 17, 18:
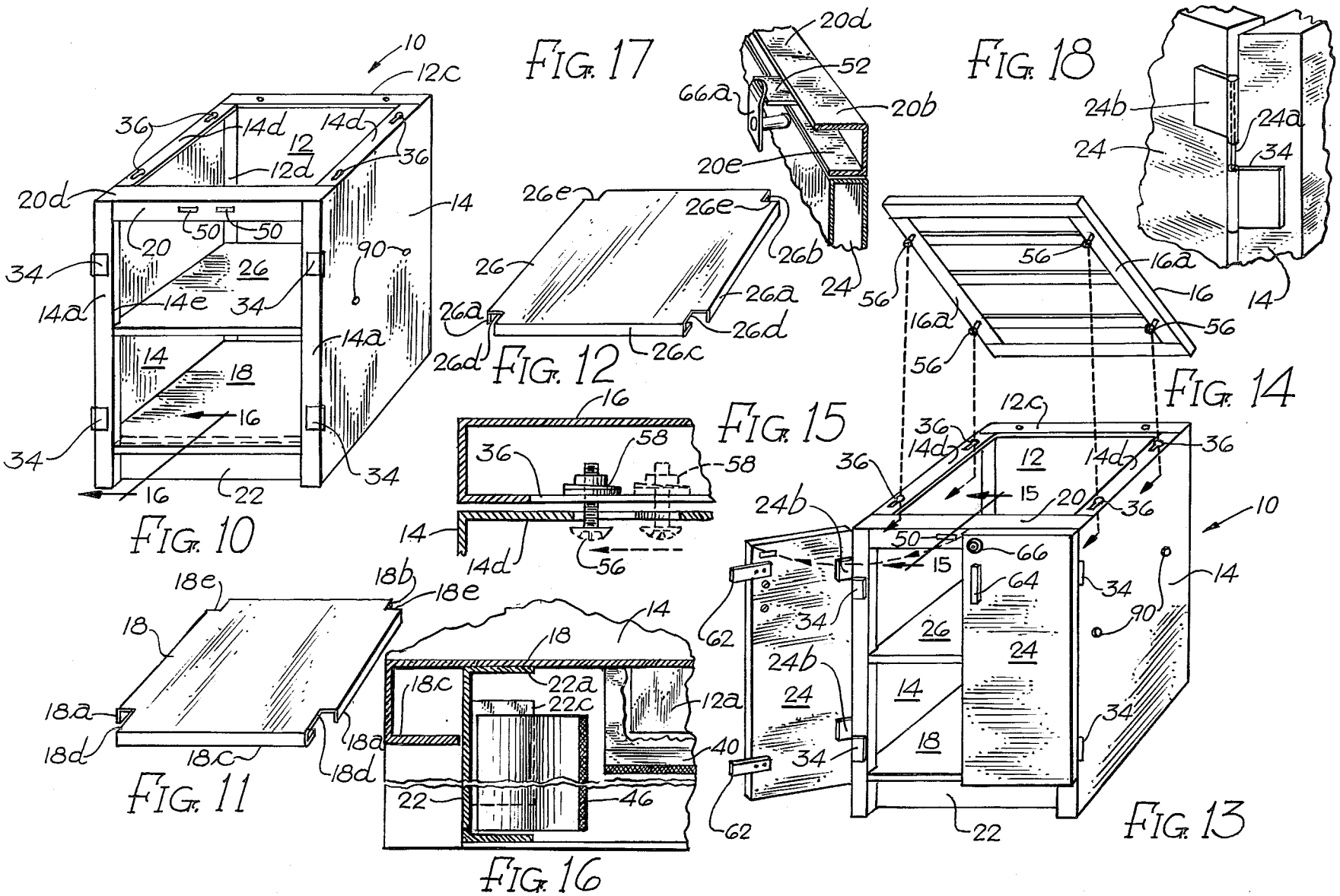
Figures 19, 20, 21, 22, 23, 24, 25:
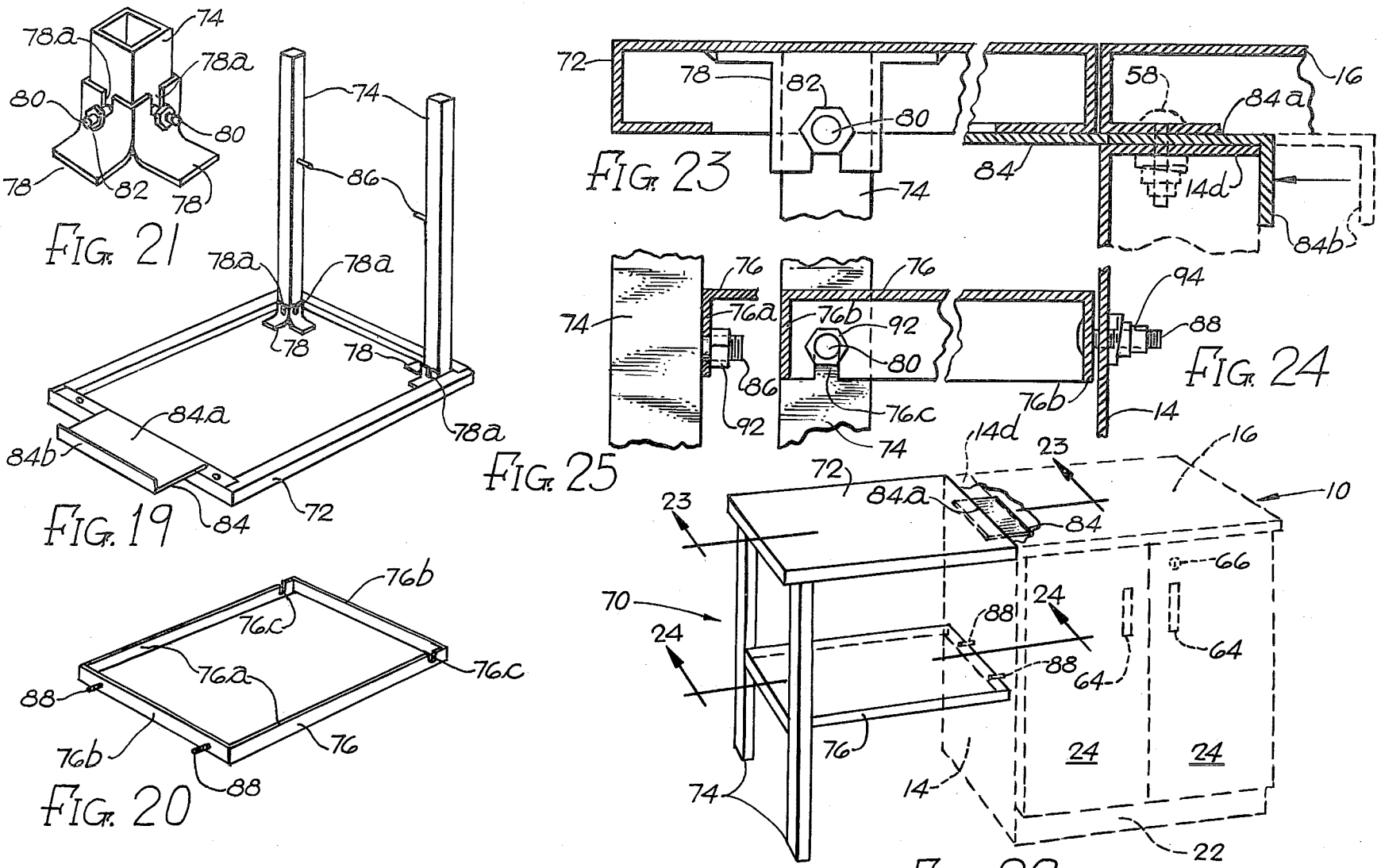

FIG. 10 is a view in perspective of the cabinet assembly with the bottom panel and shelf mounted therein;

FIG. 11 is a view in perspective of the bottom panel of the cabinet assembly;

FIG. 12 is a view in perspective of a shelf for the cabinet assembly;

FIG. 13 is a view in perspective of the cabinet assembly with the doors mounted thereon;

FIG. 14 is a view in perspective of the top panel of the cabinet assembly as viewed from its inner side;

FIG. 15 is an enlarged fragmentary sectional view taken substantially along line 15—15 of FIG. 13 showing a screw on the top panel being inserted in the keyhole slot in a flange at the top of one of the side panels of the cabinet assembly;

FIG. 16 is an enlarged fragmentary sectional view taken substantially along line 16—16 of FIG. 10;

FIG. 17 is an enlarged perspective view partly in section showing the latch of the lock on one of the doors of the cabinet assembly in its locked position;

FIG. 18 is an enlarged fragmentary view in perspective showing one of the cooperating hinge elements on the doors and side panels of the cabinet assembly;

FIG. 19 is a view in perspective of an embodiment of the side table or shelf assembly as viewed from below;

FIG. 20 is a bottom view in perspective of a shelf for the assembly shown in FIG. 19;

FIG. 21 is an enlarged fragmentary view showing one of the leg engaging sockets of the assembly shown in FIG. 19;

FIG. 22 is a view in perspective showing the side table or shelf assembly mounted on the cabinet assembly of the present invention;

FIG. 23 is an enlarged fragmentary sectional view taken substantially along line 23—23 of FIG. 22;

FIG. 24 is an enlarged fragmentary sectional view taken substantially along line 24—24 of FIG. 22; and FIG. 25 is an enlarged fragmentary sectional view showing an end of the shelf on the side table or shelf assembly secured to one of the legs of said assembly.

The embodiment of the cabinet assembly illustrated, and designated generally by reference numeral 10, comprises a back panel 12, a pair of side panels 14—14, a top panel 16, a bottom panel 18, a top rail 20 and a bottom rail 22. Doors 24—24 and a shelf 26 also are provided. The components of the assembly 10 advantageously are fabricated of a high strength metal such as steel.

Figures 1, 2, 3, 4:
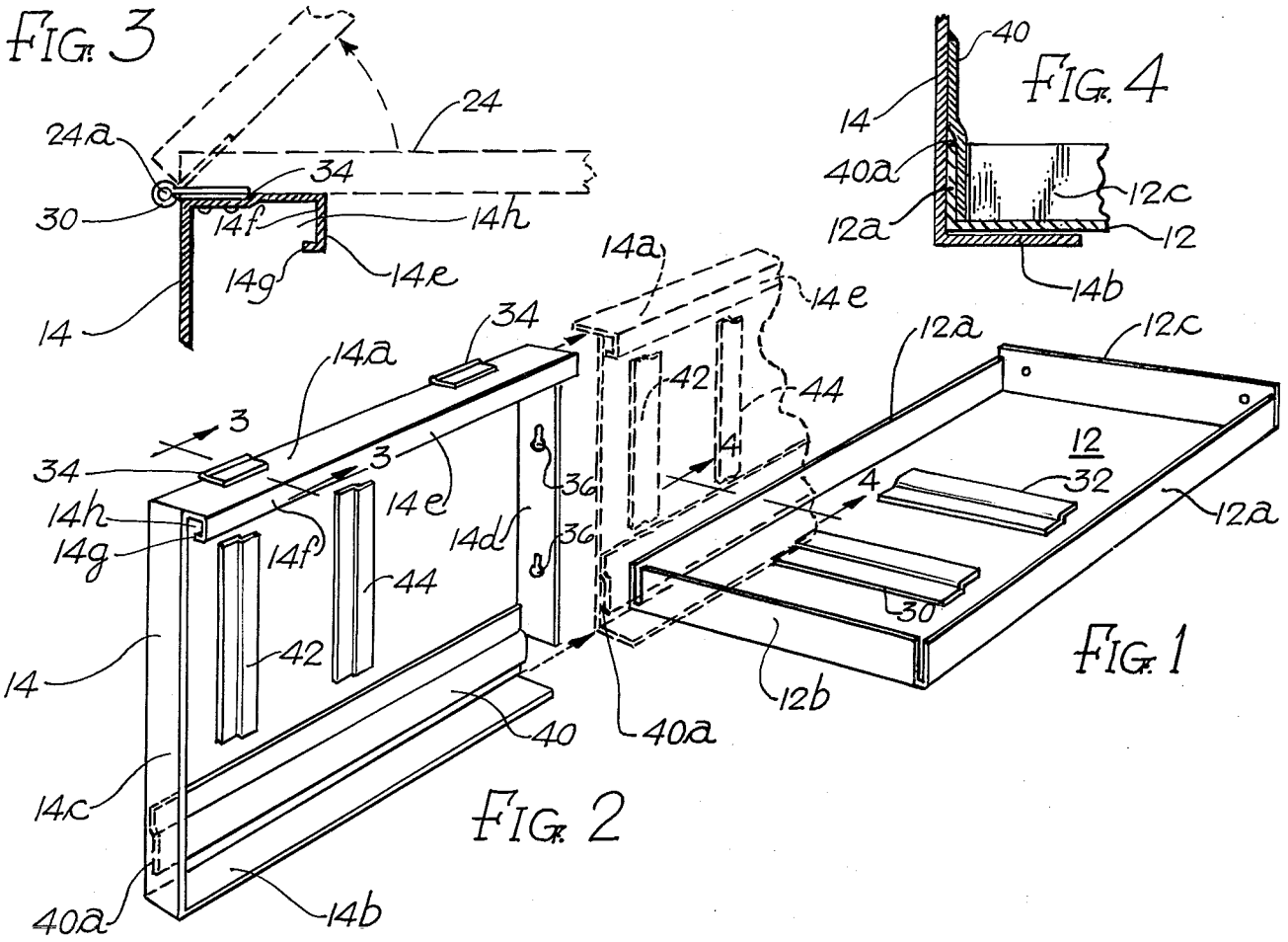
FIGS. 1 and 2 are views in perspective showing the back panel and a side panel of the cabinet assembly in position to be engaged one with the other.
FIG. 3 is an enlarged fragmentary sectional view taken substantially along line 3—3 of FIG. 2.
FIG. 4 is an enlarged fragmentary sectional view taken substantially along line 4—4 of FIG. 1.

As best shown in FIGS. 1 and 2, the back panel 12 has a pair of inwardly extending side flanges **12*a*—12*a*, a bottom flange 12*b*, and a top flange 12*c*. On the inner surface of the panel 12 there are secured a bottom rail engaging spacer bar or strip 30 and a shelf engaging spacer bar or strip 32**.

The side panels 14—14 are each formed with inwardly extending side flanges **14*a* and 14*b*, a bottom flange 14*c* and a top flange 14*d*. The side flanges 14*a* are joined along their innermost margin to a generaly L-shaped extension 14*e*, one leg 14*f* of which extends rearwardly and the other, narrower leg 14*g* of which extends laterally of and substantially parallel to the flange 14*a*. The flange 14*a*, together with the extension 14*e*, form a vertical channel 14*h* at the forward end of the side panels 14—14 in which the top rail 20 is engaged. Hinge plates 34—34 are secured to the side flanges 14*a* of the panels 14—14 for receiving hinge pins 24*a*—24*a* positioned on hinge plates 24*b*—24*b* secured on the doors 24—24 of the cabinet assembly (see FIG. 18). The top flanges 14*d* of the side panels 14—14 are provided with spaced keyhole slots 36—36**, the function of which will become clear as the description proceeds.

The inner surface of each of the side panels 14—14 have secured thereto an elongated vertical back panel engaging spacer bar or strip 40. The spacer bars or strips 40 each provide a channel **40*a* for receiving the side flanges 12*a*—12*a* of the back panel 12 (see FIGS. 1 and 2). Also secured to the inner surface of each of the side panels 14—14 are a shortened horizontally disposed bottom rail engaging spacer bar or strip 42 and a shelf engaging spacer bar or strip 44. In addition, a short lower, bottom rail engaging spacer bar or strip 46 and an upper, top rail engaging spacer bar or strip 48 are secured to the inner surface of each of the panels 14—14**.

Referring, now, in particular to FIGS. 5-9 of the drawings, the top rail 20 of the assembly 10 is generally U-shaped and comprises a pair of side panel engaging legs **20*a*—20*a* joined at their upper ends to a cross-piece 20*b*. The legs 20*a*—20*a* are essentially rectangular in cross-section, and are of a size such that they can be received, and snugly engaged, in the vertical channels 14*h* at the forward end of each of the side panels 14—14. The outer wall 20*c* of each of the legs 20*a*—20*a* is adapted to engage with the upper spacer bars or strips 46 secured on the inner surface of the side panels 14—14. The cross-piece 20*b* of the top rail 20 has an inwardly extending top flange 20*d* and bottom flange 20*e*. The ends of the top flange 20*d* are spaced from the outer wall 20*c* of the legs 20*a*—20*a* to enable the wall 20*c* to be properly positioned with relation to the spacer bars or strips 46 when the legs 20*a*—20*a* of the top rail 20 are fully inserted into the vertical channels 14*h* of the side panels 14—14. In the preferred embodiment of the cabinet assembly 10 illustrated, the top rail 20 desirably is provided with a pair of door securing magnets 50—50. In addition, a lock latch engaging bar 52 preferably is secured on the bottom flange 20*e* of the cross-piece 20*b* (see FIG. 17**).

The bottom rail 22 of the cabinet assembly 10, as illustrated, has an inwardly extending top flange **22*a* and bottom flange 22*b*, and a pair of inwardly extending side flanges 22*c*—22*c*. The corners 22*d* of the bottom rail 22 advantageously are notched to facilitate engagement of the side flanges 22*c*—22*c* with the lower spacer bars or strips 46 on the inner surface of each of the side panels 14—14**.

As best shown in FIGS. 14 and 15, the top panel 16 of the assembly 10 advantageously has boxed edges. Spaced, screw-receiving openings for screws, such as socket head screws 56, are provided in the side edges **16*a*—16*a* of the top panel 16. Threaded, screw-receiving nut-like elements 58 are secured as by welding at the openings on the inner side of the bottom wall of the edges 16*a*—16*a*. The screws 56 are adapted to be engaged in the keyhole openings 36 formed in the top flange 14*a* of each of the side panels 14—14, and may, if desired, be partially threaded into engagement with the elements 58 prior to packaging and shipping of the assembly 10**.

The bottom panel 18 of the cabinet assembly as illustrated in FIG. 11 has a pair of downwardly extending side flanges **18*a*—18*a*, and a back flange 18*b* and an L-shaped front flange 18*c*. The side flanges 18*a*—18*a* are adapted to be received in the channels formed by the spacer bars or strips 42 on the inner surface of the side panels 14—14. The back flange 18*b* is adapted to be engaged in the channel formed by the spacer bar or strip 30 on the inner surface of the back panel 12. The L-shaped front flange 18*c* of the bottom panel 18 extends forwardly of the bottom rail 22 so that the inner surface of the shelf rests on the top flange 22*a* of the rail 22. The front corners 18*d*—18*d* of the panel 18 are deeply notched to accommodate the extension 14*e* of the side panels 14—14. The rear or back corners 18*e*—18*e* of the panel 18 also are notched to accommodate the side flanges 12*a* of the back panel 12**.

The shelf 26 shown in FIG. 12 is similar in construction to the bottom panel 18 in that it has downwardly extending side flanges **26*a*—26*a*, a back flange 26*b* and an L-shaped front flange 26*c*. The side flanges 26*a*—26*a* are engaged with the channels formed by the spacer bars or strips 44 on the inner surface of the side panels 14—14. The back flange 26*b* is received in the channel formed by the spacer bar or strip 32 on the inner surface of the back panel 12. The front corners 26*d*—26*d* of the shelf 26 are notched to accommodate the extension 14*e* of the side panels 14—14, and the rear or back corners 26*e*—26*e* are notched to accommodate the side flanges 12*a* of the back panel 12. The front corners 26*d*—26*d* are more deeply notched than the back corners 26*e*—26*e* so that one can easily distinguish the front from the rear side of the shelf 26**.

The doors 24—24 of the cabinet assembly 10 have boxed edges and are each provided with striking plates 60 at the upper corners thereof which cooperate with the magnets 50—50 on the top rail 20 to maintain the doors closed. As indicated above, the outer margins of the doors 24—24 are provided with hinge plates **24*b*—24*b* which carry the pins 24*a*—24*a* for hanging the doors on the side panels 14—14. Stops 62—62 desirably are positioned on one of the doors, and handles 64—64 are secured along the inner margin of each of the doors. A key lock 66 may be provided for one of the doors. The lock 66 has a latch 66*a* which engages the latch bar 52 on the bottom flange 20*e* of the top rail 20 (see FIG. 17**).

Referring, now, to FIGS. 19-25 of the drawings, the embodiment of the optional table assembly 70 there shown comprises a table top 72, a pair of legs 74—74, and, desirably, a shelf 76. The table top 72 has boxed edges, and the undersurface thereof is provided with a pair of leg receiving sockets 78—78. The lower edges of the sockets 78—78 have recesses 78a—78a formed therein for receiving externally threaded screw shanks 80—80 secured on the inwardly facing sides of the legs 74—74. The legs 74—74 are rigidly fastened in the sockets 78—78 by means of nuts 82—82 threaded on the shanks 80—80.

The table top 72 further is provided with a relatively wide L-shaped cabinet assembly engaging extension 84 which is secured to the side of the top 72 opposite to the side thereof on which the sockets 78—78 are located. The horizontal portion 84a of the extension 84 is adapted to overlie the top flange 14d of one of the side panels 14—14 while the downwardly extending portion 84b of the extension 84 is adapted to engage the innermost margin of the top flange 14d. The top panel 16 of the cabinet assembly 10, in turn, is adapted to overlie the horizontal portion 84a of the extension 84. The width of the portion 84a is such that it does not cover the screw-receiving keyhole slots 36—36 formed in the top flange 14d, and, therefore, does not interfere with attachment of the top panel 16 on the side panels 14—14 of the cabinet assembly 10. Also, as shown in FIGS. 10, 13 and 22, the top flanges 14d—14d of the side panels 14—14 lie in a plane slightly lower than that of both the top flange 12c of the back panel 12 and the top flange of the top rail 20. The clearance thus obtained is sufficient to accommodate the thickness of the portion 84a of the extension 84. The top panel 16, therefore, will be perfectly level and will form a continuous level surface with the table top 72 of the assembly 70.

The shelf 76 of the table assembly 70 has downwardly extending side flanges 76a—76a and end flanges 76b—76b. The side flanges 76a—76a have recesses 76c—76c formed therein for receiving externally threaded screw shanks 86—86 secured on the legs 74—74. One of the end flanges 76b of the shelf 76 is provided with a pair of spaced, externally threaded screw shanks 88—88 adapted to be inserted into normally plugged openings 90—90 formed in the side panels 14 of the cabinet assembly 10. As shown in FIGS. 24 and 25, the shelf 76 is rigidly secured in position by means of nuts 92—92 threaded on the shanks 86—86 on the legs 74—74, and nuts 94—94 threaded on the shanks 88—88 which extend through the side panel 14.

As indicated hereinabove, the assembly of the cabinet 10 can be achieved readily and with minimal effort on the part of the assembler. More specifically in this connection, the first step in putting the cabinet assembly together involves positioning the back panel 12 on a flat surface with flanges 12a, 12b and 12c facing upwardly. The side panels 14—14 are then engaged with the back panel 12 by sliding the side flanges 12a—12a of the back panel 12 into the channel 40a formed by the elongated spacer bars or strips 40 secured on the inner surface of the panels 14—14. The back panel 12, together with the assembled side panels 14—14 are then placed in an upright position. The bottom rail 22 is slid into position by engaging the side flanges 22c—22c of the bottom rail 22 into engagement with the lower, short spacer bars or strips 46 positioned on the inner surface at the forward end of the side panels 14—14. The top rail 20 thereafter is engaged on the assembly 10 by inserting the legs 20a—20a into the channel 14h formed by the top flange 14a and the L-shaped flange 14e at the front of the side panels 14—14. As the legs 20a—20a of the top panel 20 are slid into position in the channel 14h, the outer walls 20c—20c of the legs are rigidly engaged in the upper, short spacer bars or strips 48 secured on the inner surface of the panels 14—14.

The bottom panel 18 is installed within the partially assembled cabinet by inserting it between the side panels 14—14 at an angle and then lowering it into position, with the deep notches 18d—18d facing forwardly, to engage the side flanges 18a—18a in the spacer bars or strips 42 on the inner surface of the side panels 14—14, and the back flange 18b in the spacer bar or strip 30 secured on the inner surface of the back panel 12.

The shelf 26 is installed in position in much the same manner as is the bottom panel 18, that is, the shelf is inserted between the side panels 14—14 at an angle with the deep notches 26d—26d facing forwardly, and the shelf is then lowered into position to engage the side flanges 26a—26a in the spacer bars or strips 44 on the inner surface of the side panels 14—14 and the back flange 26b in the spacer bar or strip 32 on the back panel 12.

The doors 24—24 are installed by engaging the fixed hinge pins 24a—24a carried by the hinge plates 24b—24b on the doors into the openings of the hinge plates 24—24 affixed to the flanges 14a of the side panels 14—14.

The top panel 16 is installed by inserting the heads of the screws 56 into the rounded portion of the keyhole slots 36 formed in the top flanges 14d of the side panels 14—14, and sliding the threaded shanks of the screws forwardly into the narrow portion of the keyhole slots 36. The screws 56, thereafter, are tightened against the flanges 14d.

In those instances where the side table or shelf assembly 70 is to be used in conjunction with the cabinet assembly 10, the top panel 16 is not positioned on the assembly 10 until after the extension 84 on the table top 72 of the assembly 70 has been engaged on an upper flange 14d of a side panel 14 as shown in FIG. 22 of the drawings. Engagement of the extension 84 on the side panel, of course, is carried out after the legs 74 of the assembly 70 have been engaged in the sockets 78—78 as described hereinabove. The shelf 76 of the assembly 70 is placed in position by first removing the plugs from the normally closed openings 90—90 in the side panel 14 and then inserting the threaded shanks 88—88 into the openings in the panel 14. The shelf, thereafter, is lowered to engage the threaded shanks 86 on the legs 74 in the recesses 76c—76c formed in the side flanges 76a of the shelf 76.

The completed assembly as shown in FIG. 22 is rigid and stable, and has the advantage of enabling the cabinet assembly 10 to be used for storage purposes as well as providing a long, wide working surface as represented by the top panels 16 and 72.

It should be understood that the embodiment of the invention just described is to be regarded as illustrative of one embodiment, only, of the invention and the the invention may be embodied in other forms without departing from the spirit or essential characteristics thereof.

What is claimed is:

1. A knockdown cabinet assembly comprising a back panel having inwardly extending top, bottom and side flanges, a pair of side panels having inwardly extending top, bottom, front and rear flanges, the front flange on each of the side panels being formed to provide an elongated open-ended channel, flange receiving means secured on each of the side panels forwardly of and substantially parallel to the rear flange therefor for slidably engaging the inwardly extending side flanges on the back panel, a bottom connecting member and a top connecting member adapted to engage the side panels and to maintain them in fixed spaced apart relation with respect to one another, said top connecting member having downwardly extending portions adapted to be slidably received in the open-ended channel provided by the front flange of the side panels, a top panel having fastening means for securing the top panel on the top flanges of the side panels, and a bottom panel adapted to be supported on the back and side panels is spaced relation to the inwardly extending bottom flanges thereof.

2. A cabinet assembly according to claim 1 wherein the bottom panel has downwardly extending flanges, and the back panel and the side panels are each provided with flange receiving means for engaging the downwardly extending flanges of the bottom panel.

3. A cabinet assembly according to claim 1 wherein a shelf having downwardly extending flanges is provided for the assembly, and the side panels and the back panel are provided with flange engaging means adapted to slidably receive the flanges on the shelf.

4. A cabinet assembly according to claim 1 wherein a side table assembly is provided for the cabinet assembly, the side table assembly having a side panel engaging extension adapted to overlie and engage the top flange of one of the side panels, and to be maintained in position by the top panel of the cabinet assembly.

5. A cabinet assembly according to claim 4 wherein the side table assembly comprises a top panel which is supported by legs and by the side panel engaging extension when the extension is secured on the side panel of the cabinet assembly.

6. A cabinet assembly according to claim 4 wherein a shelf is provided for the side table assembly, said shelf having means for engaging the legs of the side table assembly and a side panel of the cabinet assembly.

7. A knockdown cabinet assembly comprising a back panel having inwardly extending side flanges and an inwardly extending top and bottom flange, a pair of side panels having an inwardly extending front and rear flange and an inwardly extending top and bottom flange, said front flange being formed to provide an open-ended vertically extending channel at the forward margin of the side panels, vertically extending flange engaging means secured to the inner surface of each of the side panels forwardly of the inwardly extending rear flange of the side panels for slidably receiving the inwardly extending side flanges of the back panel, spaced apart, horizontally extending flange engaging means secured on the inner surface of the side panels adjacent to the upper and lower ends of the open-ended vertically extending channel at the forward margin of the side panels, a bottom connecting member having inwardly extending side flanges slidably engageable with the horizontally extending flange engaging means adjacent to the lower end of the open-ended vertically extending channel at the forward margin of the side panels, a top connecting member having downwardly extending portions adapted to be slidably engaged in the vertically extending channel provided by the front flange of each of the side panels, said downwardly extending portions of the top connecting member being partially slidably engageable with the horizontally extending flange engaging means adjacent to the upper end of said open-ended vertically extending channel provided by the front flange of each of the side panels, a bottom panel, and a top panel having means along the side margins thereof for enabling it to be releasably secured to the top flange of the side panels.

8. A knockdown cabinet assembly according to claim 7 wherein a pair of vertically spaced horizontally extending flange engaging means is provided on the inner surface of the back panel and on the inner surface of each of the side panels, the lowermost of said pair of flange engaging means serving to releasably support the bottom panel of the assembly and the uppermost of said pair of flange engaging means serving to releasably support a shelf between the side panels of the assembly.

9. A knockdown cabinet assembly according to claim 7 wherein doors are provided for the assembly, the doors having hinge means secured along the outer side margins thereof, and the front flange of the side panels of the assembly are each provided with hinge means which interconnect with the hinge means on the doors.

10. In combination, a knockdown cabinet assembly as claimed in claim 7, and a side table assembly, said side table assembly comprising a table top having leg engaging means at one end thereof and cabinet assembly engaging means at the other end thereof, said cabinet assembly engaging means including a side panel engaging extension adapted to overlie and engage the top flange of one of the side panels of the cabinet assembly and to be maintained in position by the top panel of said assembly, said table top and said top panel lying substantially in the same horizontal plane and cooperating to provide a continuous upper working surface for the assembly, and legs adapted to be received in the leg engaging means at said one end of the table top.

11. The combination of claim 10 wherein a shelf is provided for the side table assembly, said shelf having leg engaging means and side panel engaging means for supporting the shelf on the side table assembly.

* * * * *